US012146502B2

(12) United States Patent
Hsu et al.

(10) Patent No.: US 12,146,502 B2
(45) Date of Patent: Nov. 19, 2024

(54) IMPELLER AND FAN EMPLOYING SAME

(71) Applicant: Delta Electronics, Inc., Taoyuan (TW)

(72) Inventors: Kuo-Tung Hsu, Taoyuan (TW); Shun-Chen Chang, Taoyuan (TW); Chao-Fu Yang, Taoyuan (TW); Li-Han Hung, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 184 days.

(21) Appl. No.: 17/010,706

(22) Filed: Sep. 2, 2020

(65) Prior Publication Data

US 2021/0071681 A1 Mar. 11, 2021

Related U.S. Application Data

(60) Provisional application No. 62/896,741, filed on Sep. 6, 2019.

(51) Int. Cl.
*F04D 29/28* (2006.01)

(52) U.S. Cl.
CPC ..... *F04D 29/282* (2013.01)

(58) Field of Classification Search
CPC ..... F04D 29/282; F04D 29/30; F04D 29/666; F04D 17/16
See application file for complete search history.

(56) References Cited

U.S. PATENT DOCUMENTS

| | | | |
|---|---|---|---|
| 2015/0152883 | A1 | 6/2015 | Dybenko et al. |
| 2019/0128278 | A1 | 5/2019 | Chan et al. |

FOREIGN PATENT DOCUMENTS

| | | | |
|---|---|---|---|
| CN | 101265919 | A | 9/2008 |
| CN | 104912845 | A | 9/2015 |
| CN | 205423312 | U | 8/2016 |
| CN | 107448415 | * | 12/2017 |
| DE | 174855 | C | 10/1906 |
| JP | H10299694 | A | 11/1998 |
| JP | 2004332739 | A | 11/2004 |
| JP | 2013124653 | A | 6/2013 |
| TW | 200803710 | A | 1/2008 |
| TW | M470165 | U | 1/2014 |
| TW | 201440626 | A | 10/2014 |
| TW | M500164 | U | 5/2015 |

* cited by examiner

*Primary Examiner* — Brian O Peters

(74) *Attorney, Agent, or Firm* — KIRTON McCONKIE; Evan R. Witt

(57) ABSTRACT

An impeller and a fan are provided. The impeller includes a hub, a plurality of first blades, a plurality of second blades and a connecting member. The plurality of first blades are disposed around the hub separately. Each first blade is connected with a periphery of the hub. The plurality of second blades are disposed around the hub separately. Each second blade is disposed away from the periphery of the hub and located between two adjacent first blades of the plurality of first blades. The connecting member is disposed around the hub and penetrated through the plurality of first blades and the plurality of second blades. The connecting member is not in contact with a first edge of any side of each first blade. The connecting member is not in contact with a second edge of any side of each second blade.

12 Claims, 9 Drawing Sheets

IMPELLER AND FAN EMPLOYING SAME

CROSS-REFERENCE TO RELATED APPLICATION

This application claims the benefit of U.S. Provisional Application Ser. No. 62/896,741 filed on Sep. 6, 2019, entitled "FAN WHEEL", which is incorporated herein by reference for all purposes.

FIELD OF THE INVENTION

The present disclosure relates to an impeller and a fan, and more particularly to an impeller and a fan for achieving target air pressure and target air volume at low rotation speed and reducing noise.

BACKGROUND OF THE INVENTION

With the ongoing trend in the electronic device toward high power and high integration, the efficacy of the electronic component in the electronic device is increased continuously. Generally, the heat of the electronic component is increased as the efficacy of the electronic component is increased. If the accumulated heat fails to be removed away from the electronic component, the electronic component may be damaged or malfunctioned due to high temperature. Consequently, the electronic device cannot be worked normally and the reliability of the electronic device is decreased. For solving the above problems, a fan is employed by the electronic device and served as a heat dissipation device for removing the heat from the interior of the electronic device.

At present, for increasing the heat dissipation efficiency of the fan, the rotation speed of the fan is increased, so that the air pressure and the air volume of the fan are increased. However, the noise generated by the fan is increased as the rotation speed of the fan is increased.

Therefore, there is a need of providing an impeller and a fan so as to address the issues encountered by the prior arts.

SUMMARY OF THE INVENTION

An object of the present disclosure provides an impeller and a fan. With a specific arrangement between a plurality of main blades and a plurality of auxiliary blades, the impeller and the fan have advantages of achieving target air volume and target air pressure at low rotation speed and reducing noise generated by the fan.

In accordance with an aspect of the present disclosure, an impeller is provided. The impeller includes a hub, a plurality of first blades, a plurality of second blades and a connecting member. The plurality of first blades are disposed around the hub separately. Each of the plurality of first blades is connected with a periphery of the hub. The plurality of second blades are disposed around the hub separately. Each of the plurality of second blades is disposed away from the periphery of the hub and located between two adjacent first blades of the plurality of first blades. The connecting member is disposed around the hub and penetrated through the plurality of first blades and the plurality of second blades. The connecting member is not in contact with a first edge of any side of each of the plurality of first blades. The connecting member is not in contact with a second edge of any side of each of the plurality of second blades.

In accordance with an aspect of the present disclosure, a fan is provided. The fan includes a frame and an impeller.

The frame includes a first surface, a second surface, a side wall, a first inlet, an outlet and an accommodation space. The first inlet is disposed in the first surface. The first surface and the second surface are opposite to each other. The outlet is disposed between the first surface and the second surface. The first surface, the second surface and the side wall are defined as the accommodation space collaboratively. The first inlet, the outlet and the accommodation space are in fluid communication with each other. The impeller is disposed in the accommodation space. The impeller includes a hub, a plurality of first blades, a plurality of second blades and a connecting member. The plurality of first blades are disposed around the hub separately. Each of the plurality of first blades is connected with a periphery of the hub. The plurality of second blades are disposed around the hub separately. Each of the plurality of second blades is disposed away from the periphery of the hub and located between the two adjacent first blades of the plurality of first blades. Portion of each of the plurality of first blades is exposed to an axial projection surface of the first inlet axially. Portion of each of the plurality of second blades is exposed to the axial projection surface of the first inlet axially. The connecting member is disposed around the hub and penetrated through the plurality of first blades and the plurality of second blades.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
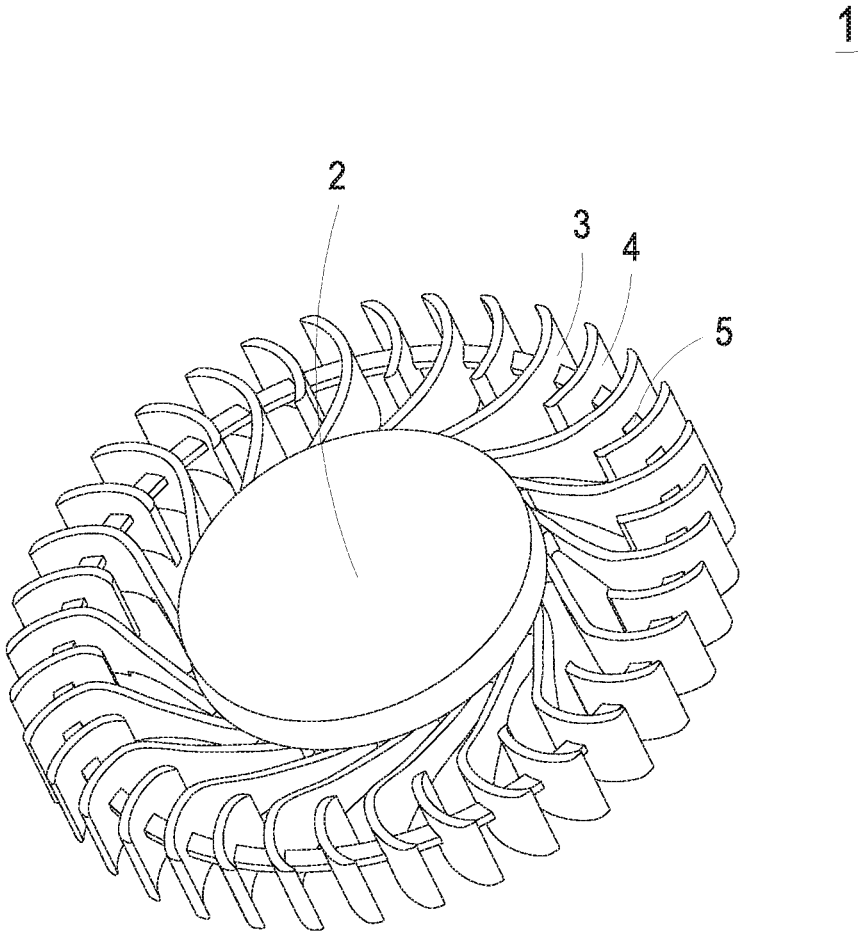
FIG. 1A is a schematic perspective view illustrating an impeller according to a first embodiment of the present disclosure.

FIG. 1A is a schematic perspective view illustrating an impeller according to a first embodiment of the present disclosure. As shown in FIG. 1A, an impeller 1 is provided. The impeller 1 is driven by a fan motor (not shown in the figure) and rotated in counterclockwise direction. The impeller 1 includes a hub 2, a plurality of first blades 3, a plurality of second blades 4 and a connecting member 5. The plurality of first blades 3 are served as main blades of the impeller 1 and disposed around the hub 2 separately. One end of each of the plurality of first blades 3 is connected with a periphery of the hub 2. Preferably but not exclusively, each of the plurality of first blades 3 is a curved blade. The plurality of second blades 4 are served as auxiliary blades of the impeller 1 and disposed around the hub 2 separately. Each of the plurality of second blades 4 is disposed away from the periphery of the hub 2. Namely, each of the plurality of second blades 4 is not connected with the periphery of the hub 2. Preferably but not exclusively, each of the plurality of second blades 4 is a curved blade. Each of the plurality of second blades 4 is located between the two adjacent first blades 3. In an embodiment, the plurality of first blades 3 and the plurality of second blades 4 are arranged alternately and sequentially and are disposed around the hub 2.

In this embodiment, the shape of the hub 2 is a cylinder. There is no any extension structure of the hub 2 connected with the plurality of first blades 3.

Figure 1B:
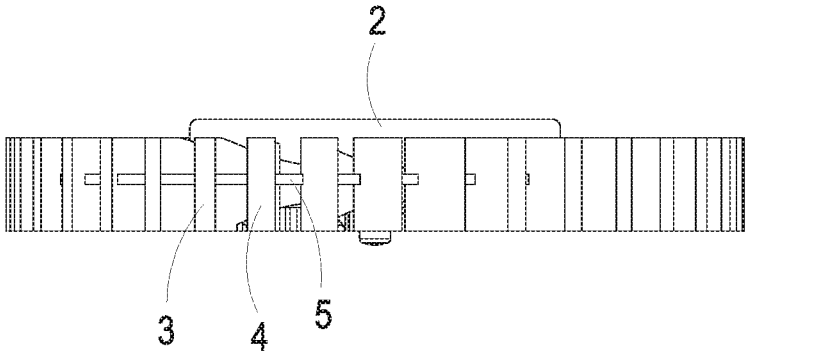
FIG. 1B is a schematic side view illustrating the impeller of FIG. 1A.

FIG. 1B is a schematic side view illustrating the impeller of FIG. 1A. As shown in FIGS. 1A and 1B, the connecting member 5 of the impeller 1 is disposed around the hub 2 and connected with the plurality of first blades 3 and the plurality of second blades 4. The connecting member 5 is a connecting ring penetrating through the plurality of first blades 3 and the plurality of second blades 4. In this embodiment, the connecting member 5 is penetrated through the center of the blade surface of each first blade 3. The connecting member 5 is not in contact with a first edge of any side of each first blade 3. The connecting member 5 is penetrated through the center of the blade surface of each second blade 4. The connecting member 5 is not in contact with a second edge of any side of each second blade 4.

Figure 1C:
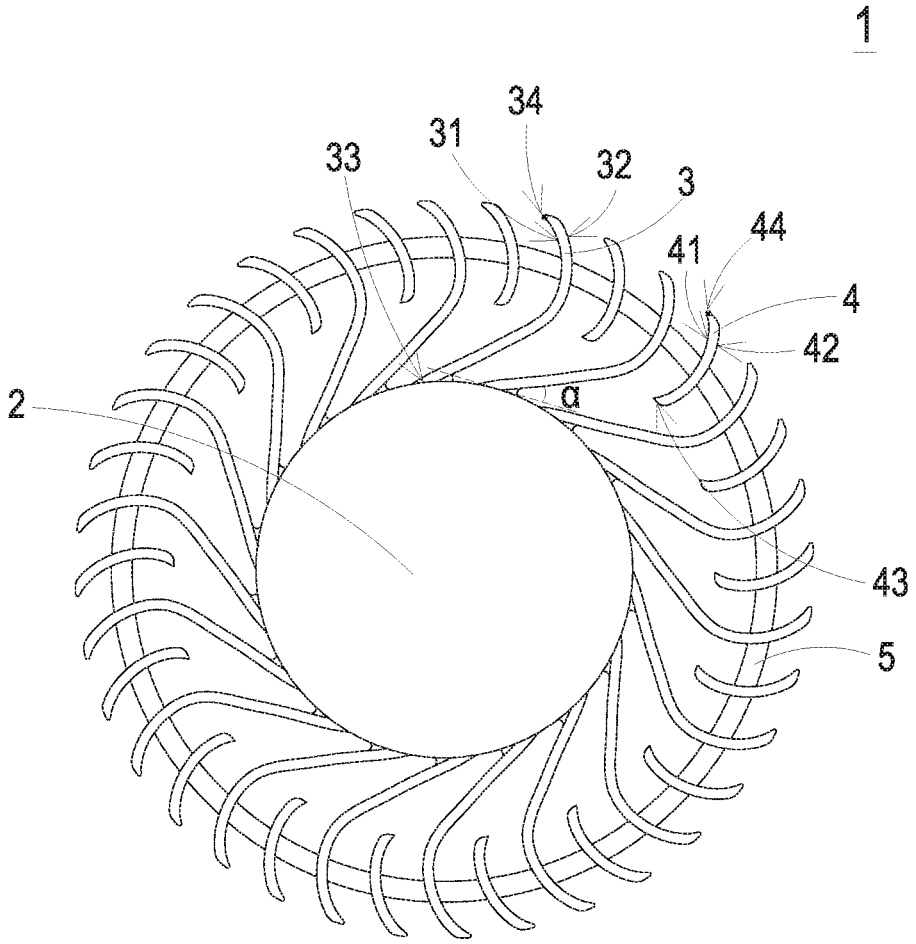
FIG. 1C is a schematic top view illustrating the impeller of FIG. 1A.

FIG. 1C is a schematic top view illustrating the impeller of FIG. 1A. As shown in FIGS. 1A and 1C, each of the plurality of first blades 3 includes a first blade surface 31, a second blade surface 32 and a connecting end 33. The first blade surface 31 and the second blade surface 32 of the first blade 3 are opposite to each other. In this embodiment, the impeller 1 is rotated in counterclockwise direction. Consequently, the first blade surface 31 is served as a windward surface of the first blade 3. The second blade surface 32 is served as a leeward surface of the first blade 3. The connecting member 5 of the impeller 1 is penetrated through a first center of the first blade surface 31 and a second center of the second blade surface 32 of each first blade 3, so that each of the plurality of first blades 3 is connected with the connecting member 5. The connecting end 33 of the first blade 3 is connected with the periphery of the hub 2. Portion of the first blade 3 adjacent to the connecting end 33 (referred to as a first portion of the first blade 3) is extended along radial direction centrifugally from the periphery of the hub 2. The other portion of the first blade 3 located away from the connecting end 33 (referred to as a second portion of the first blade 3) is curved and extended along radial direction centrifugally from the first portion of the first blade 3. The first blade 3 and the periphery of the hub 2 are non-orthogonal. In this embodiment, the extension direction of the second blade surface 32 of the first portion of the first blade 3 extended outwardly from the hub 2 is defined as a first direction. The tangent direction of an interconnection between the periphery of the hub 2 and the second blade surface 32 of the first portion of the first blade 3 is defined as a second direction, as shown in the dotted line of FIG. 1C. There is an angle $\alpha$ formed between the first direction and the second direction. The angle $\alpha$ is an acute angle. The first blade 3 further includes a first leading edge 34. The first leading edge 34 is located in an interconnection between the first blade surface 31 and the second blade surface 32. The first leading edge 34 is disposed away from the hub 2 than the connecting end 33. The first leading edge 34 is located in the periphery of the impeller 1.

Each of the plurality of second blades 4 includes a third blade surface 41, a fourth blade surface 42 and an inner end 43. The third blade surface 41 and the fourth blade surface 42 of the second blade 4 are opposite to each other. In this embodiment, the impeller 1 is rotated in counterclockwise direction. Consequently, the third blade surface 41 is served as a windward surface of the second blade 4. The fourth blade surface 42 is served as a leeward surface of the second blade 4. The connecting member 5 of the impeller 1 is penetrated through a third center of the third blade surface 41 and a fourth center of the fourth blade surface 42 of each second blade 4, so that each of the plurality of second blades 4 is connected with the connecting member 5. The third blade surface 41 of the second blade 4 is adjacent to the second blade surface 32 of the adjacent first blade 3. The fourth blade surface 42 of the second blade 4 is adjacent to the first blade surface 31 of the other adjacent first blade 3. The inner end 43 of the second blade 4 is one end of the second blade 4 adjacent to the hub 2. The inner end 43 of the second blade 4 is not in contact with the periphery of the hub 2. In this embodiment, the distance between the inner end 43 of each second blade 4 and the periphery of the hub 2 is identical. The second blade 4 includes a second leading edge 44. The second leading edge 44 is located in an interconnection between the third blade surface 41 and the fourth blade surface 42. The second leading edge 44 is disposed away from the hub 2 than the inner end 43. The second leading edge 44 is located in the periphery of the impeller 1.

Figure 2:
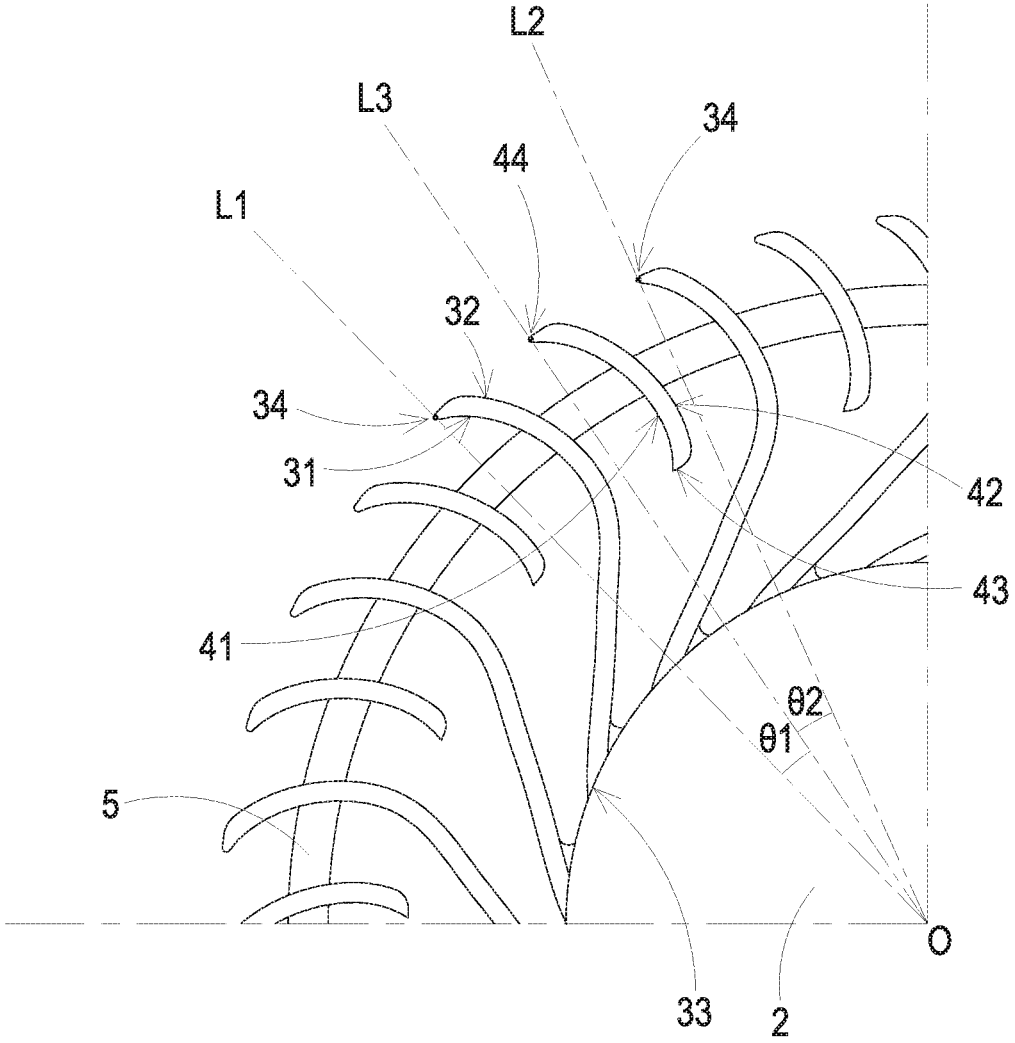
FIG. 2 is a schematic perspective top view illustrating a portion of the impeller of FIG. 1A.

FIG. 2 is a schematic perspective top view illustrating a portion of the impeller of FIG. 1A. As shown in FIG. 2, the hub 2 includes an axis center O. A first line L1 is formed between the first leading edge 34 of the Nth first blade 3 of the plurality of first blades 3 and the axis center O. A second line L2 is formed between the first leading edge 34 of the (N+1)th first blade 3 of the plurality of first blades 3 and the axis center O. A third line L3 is formed between the second leading edge 44 of the second blade 4 and the axis center O, wherein the second leading edge 44 of the second blade 4 is located between the Nth first blade 3 and the (N+1)th first blade 3. A first angle $\theta 1$ is formed between the first line L1 and the third line L3. A second angle $\theta 2$ is formed between the second line L2 and the third line L3. In this embodiment, the magnitude of the first angle $\theta 1$ is equal to the magnitude of the second angle $\theta 2$. N is a natural number. In the other embodiments, the magnitude of the first angle $\theta 1$ is not equal to the magnitude of the second angle $\theta 2$.

Figure 3:
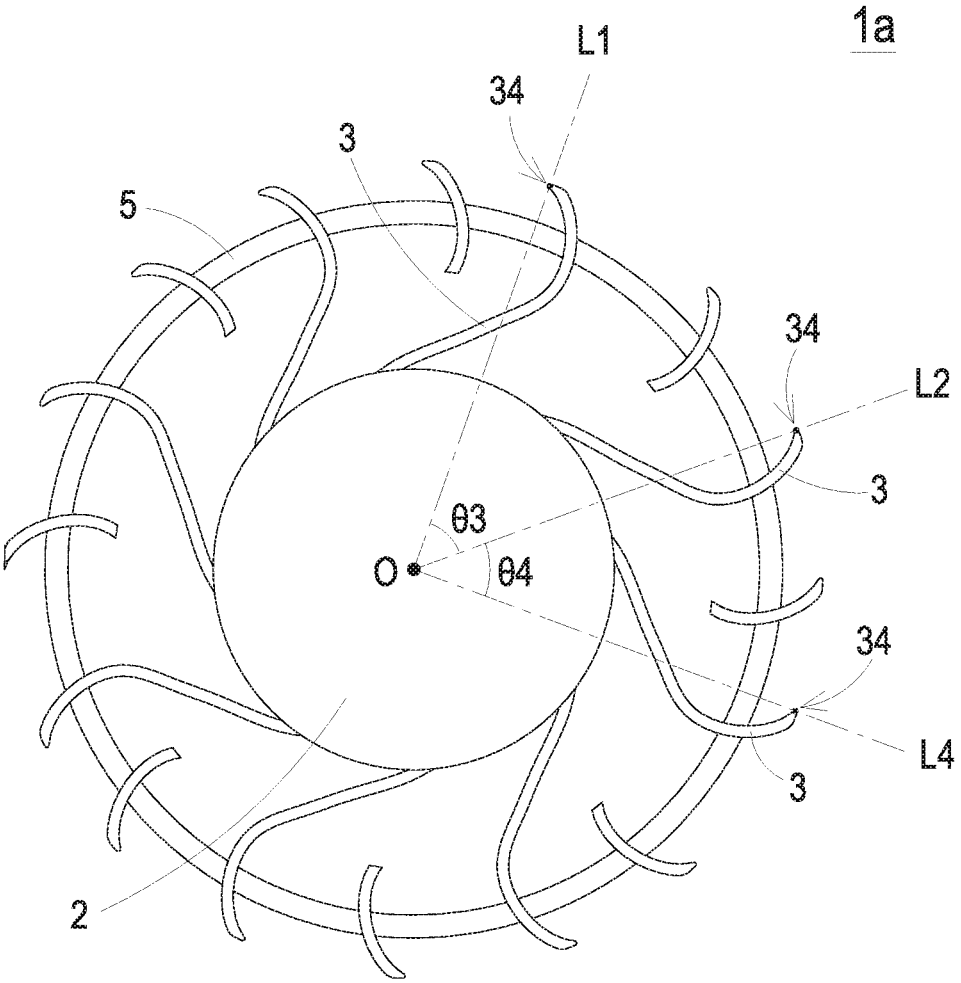
FIG. 3 is a schematic perspective view illustrating an impeller according to a second embodiment of the present disclosure.

FIG. 3 is a schematic perspective view illustrating an impeller according to a second embodiment of the present disclosure. As shown in FIG. 3, the impeller 1*a* of this embodiment includes a hub 2, a plurality of first blades 3, a plurality of second blades 4 and a connecting member 5. The structures and functions of the hub 2, the plurality of first blades 3, the plurality of second blades 4 and the connecting member 5 of the impeller 1*a* of this embodiment are similar to those of FIGS. 1C and 2. Component parts and elements corresponding to those of FIGS. 1C and 2 are designated by identical numeral references, and detailed descriptions thereof are omitted. In this embodiment, the angle between the plurality of first blades 3 and the plurality of second blades 4 of the impeller 1*a* of this embodiment is different from the angle between the plurality of first blades 3 and the plurality of second blades 4 of the impeller 1 of FIG. 1. In this embodiment, a first line L1 is formed between the first leading edge 34 of the Nth first blade 3 of the plurality of first blades 3 and the axis center O. A second line L2 is formed between the first leading edge 34 of the (N+1)th first blade 3 of the plurality of first blades 3 and the axis center O. A fourth line L4 is formed between the first leading edge 34 of the (N+2)th first blade 3 of the plurality of first blades 3 and the axis center O. A third angle θ3 is formed between the first line L1 and the second line L2. A fourth angle θ4 is formed between the second line L2 and the fourth line L4. In this embodiment, the magnitude of the third angle θ3 is not equal to the magnitude of the fourth angle θ4. N is a natural number.

Figure 4:
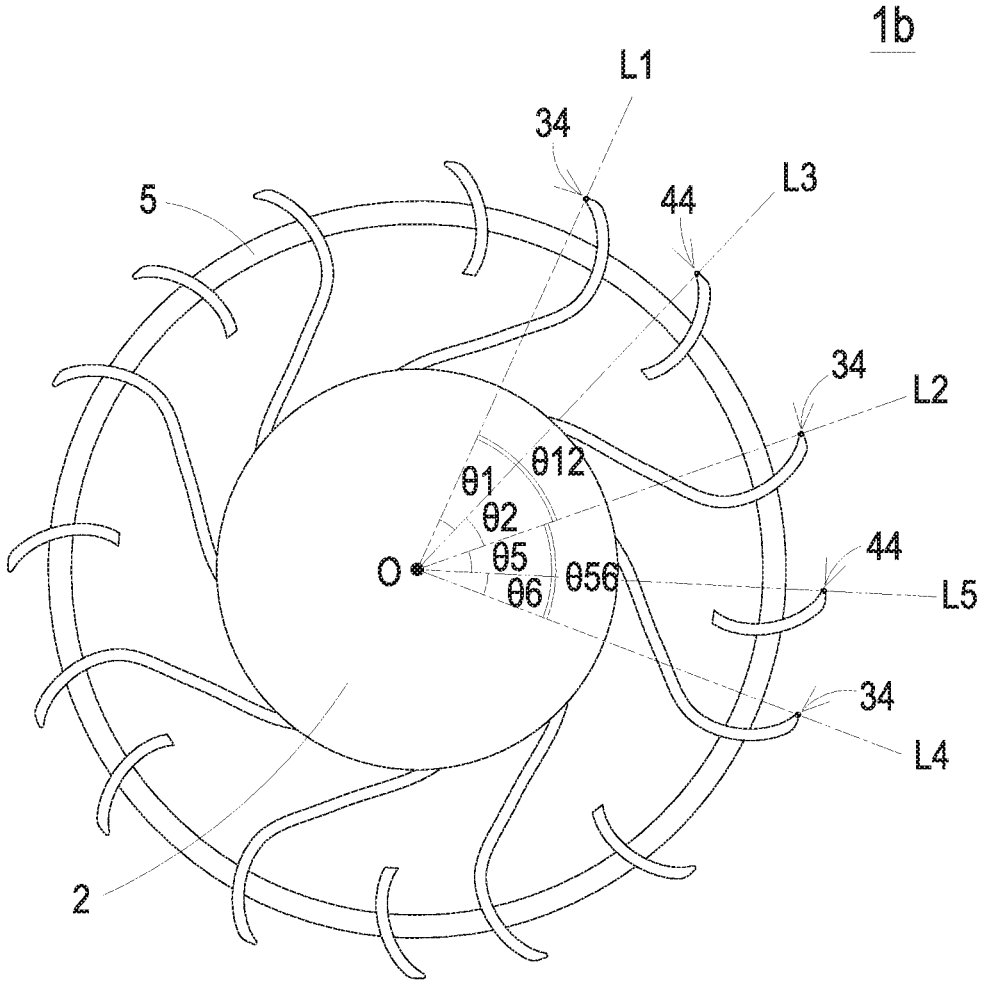
FIG. 4 is a schematic perspective view illustrating an impeller according to a third embodiment of the present disclosure.

FIG. 4 is a schematic perspective view illustrating an impeller according to a third embodiment of the present disclosure. As shown in FIG. 4, the impeller 1*b* of this embodiment includes a hub 2, a plurality of first blades 3, a plurality of second blades 4 and a connecting member 5. The structures and functions of the hub 2, the plurality of first blades 3, the plurality of second blades 4 and the connecting member 5 of the impeller 1*b* of this embodiment are similar to those of FIGS. 1C and 2. Component parts and elements corresponding to those of FIGS. 1C and 2 are designated by identical numeral references, and detailed descriptions thereof are omitted. In this embodiment, the angle between the plurality of first blades 3 and the plurality of second blades 4 of the impeller 1*b* is different from the angle between the plurality of first blades 3 and the plurality of second blades 4 of the impeller 1 of FIG. 1. In this embodiment, a first line L1 is formed between the first leading edge 34 of the Nth first blade 3 of the plurality of first blades 3 and the axis center O. A second line L2 is formed between the first leading edge 34 of the (N+1)th first blade 3 of the plurality of first blades 3 and the axis center O. A third line L3 is formed between the second leading edge 44 of the Mth second blade 4 and the axis center O, wherein the second leading edge 44 of the Mth second blade 4 is located between the Nth first blade 3 and the (N+1)th first blade 3. A first angle θ1 is formed between the first line L1 and the third line L3. A second angle θ2 is formed between the second line L2 and the third line L3. In this embodiment, the magnitude of the first angle θ1 is not equal to the magnitude of the second angle θ2. The first angle θ1 and the second angle 02 are combined to form a first combination angle θ12. N and M are natural numbers.

Please refer to FIG. 4 again. A fourth line L4 is formed between the first leading edge 34 of the (N+2)th first blade 3 of the plurality of first blades 3 and the axis center O. A fifth line L5 is formed between the second leading edge 44 of the (M+1)th second blade 4 and the axis center O, wherein the second leading edge 44 of the (M+1)th second blade 4 is located between the (N+1)th first blade 3 and the (N+2)th first blade 3. A fifth angle θ5 is formed between the second line L2 and the fifth line L5. A sixth angle θ6 is formed between the fifth line L5 and the fourth line L4. In this embodiment, the magnitude of the fifth angle θ5 is not equal to the magnitude of the sixth angle θ6. The fifth angle θ5 and the sixth angle θ6 are combined to form a second combination angle θ56. N and M are natural numbers. In this embodiment, the magnitude of the first combination angle θ12 is equal to the magnitude of the second combination angle θ56.

Figure 5A:
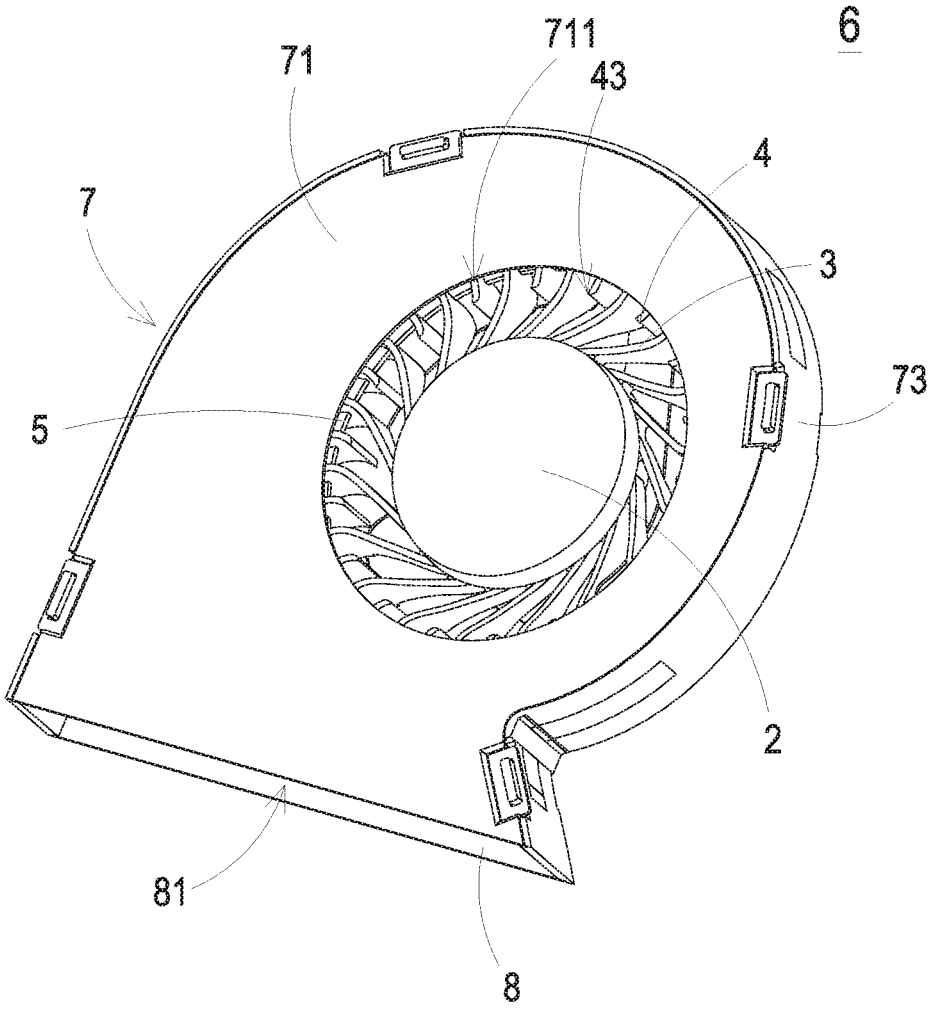
FIG. 5A is a schematic perspective view illustrating a fan with the impeller according to an embodiment of the present disclosure.

FIG. 5A is a schematic perspective view illustrating a fan with the impeller according to an embodiment of the present disclosure. FIG. 5C is a schematic bottom view illustrating the fan of FIG. 5A. As shown in FIGS. 5A and 5C, a fan 6 is provided. The fan 6 includes a frame 7 and an impeller 1. In some embodiments, the impeller 1, 1*a* and 1*b* can be applied to the fan 6, and detailed descriptions thereof are omitted. The frame 7 includes a first surface 71, a second surface 72, a side wall 73, a first inlet 711, an accommodation space 8 and an outlet 81. The first surface 71 and the second surface 72 of the frame 7 are opposite to each other. The side wall 73 is disposed between the first surface 71 and the second surface 72 of the frame 7. One side of the side wall 73 is connected with portion of the first surface 71 and disposed around the first surface 71. The other side of the side wall 73 is connected with portion of the second surface 72 and disposed around the second surface 72. The first inlet 711 is disposed in the first surface 71 and served as an airflow entrance for dissipating the heat. The first surface 71, the second surface 72 and the side wall 73 are defined as the accommodation space 8 collaboratively. The impeller 1 is disposed in the accommodation space 8. The outlet 81 is disposed between the first surface 71 and the second surface 72 and served as an airflow exit for dissipating the heat. The outlet 81, the first inlet 711 and the accommodation space 8 are in fluid communication with each other and formed as an airflow channel. In this embodiment, the outlet direction of the outlet 81 is perpendicular to the inlet direction of the first inlet 711. In this embodiment, the fan 6 further includes a fan motor (not shown in the figure). The fan motor is connected with the impeller 1 and disposed in the accommodation space 8 of the frame 7. The fan motor of the fan 6 drives the impeller 1 to rotate. Consequently, the airflow from the first inlet 711 is introduced into the accommodation space 8, and then the airflow is exhausted from the outlet 81 to dissipate the heat. Therefore, dissipating the heat generated by the electronic component in the interior of the electronic device actively is achieved.

Figure 5B:
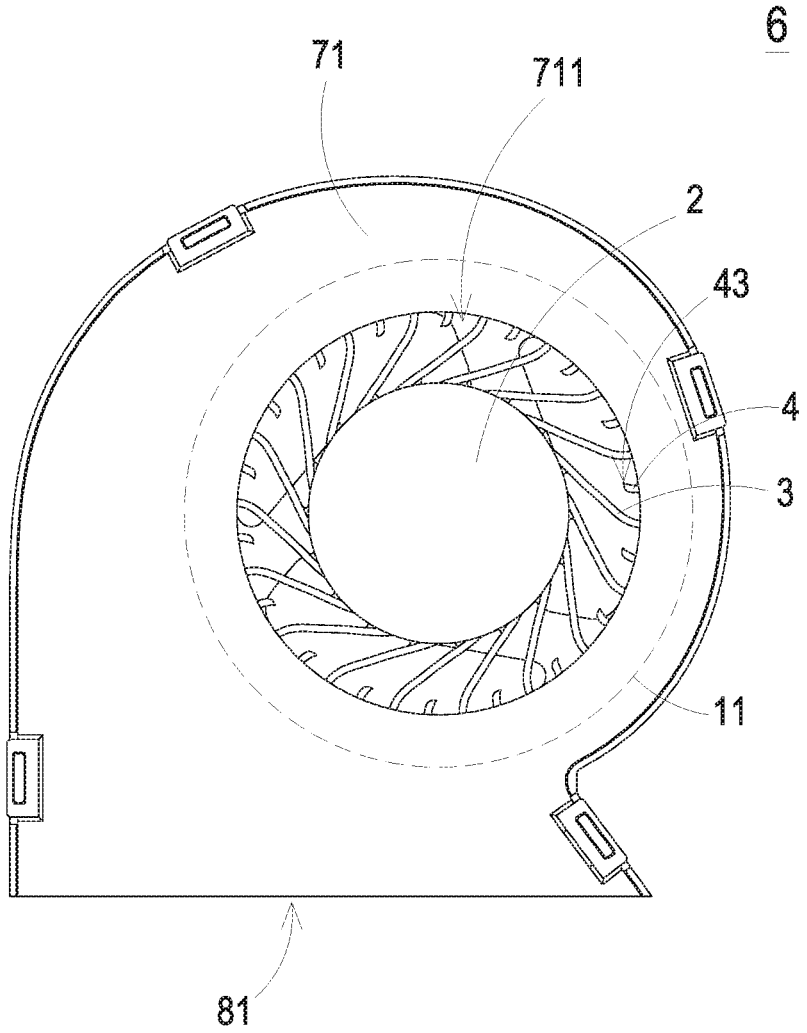
FIG. 5B is a schematic top view illustrating the fan of FIG. 5A.
Figure 5C:
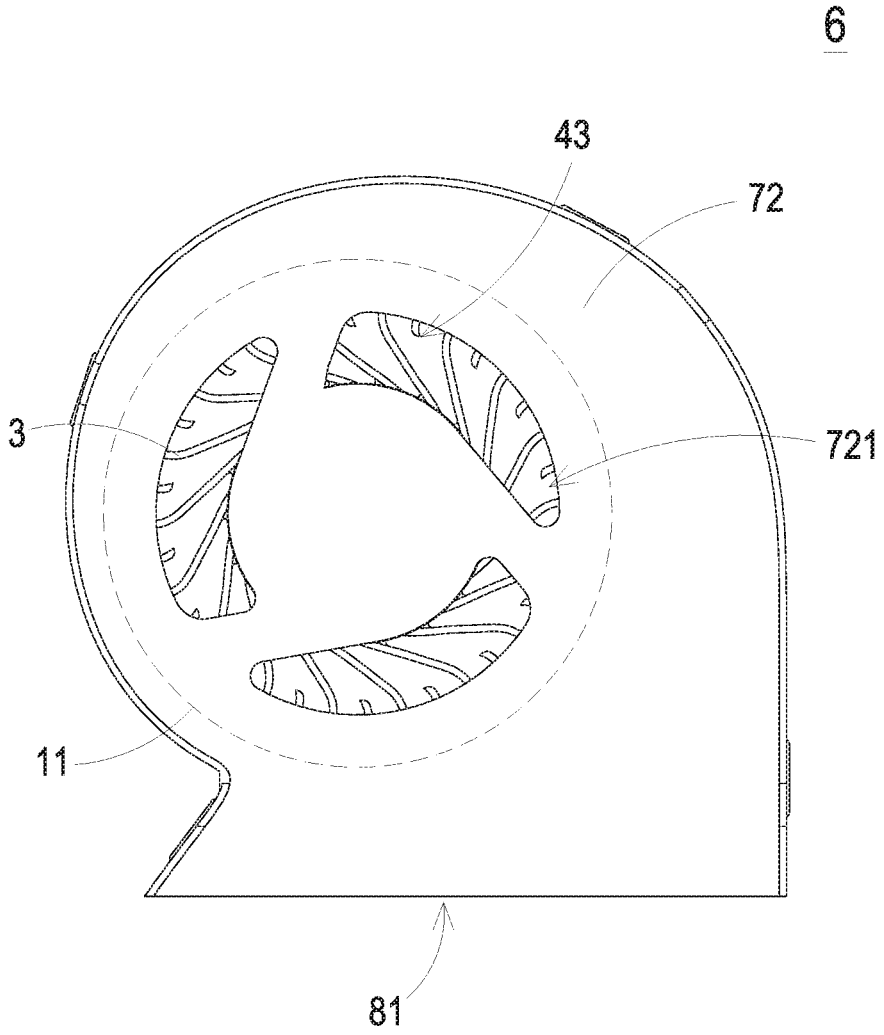
FIG. 5C is a schematic bottom view illustrating the fan of FIG. 5A.

FIG. 5B is a schematic top view illustrating the fan of FIG. 5A. As shown in FIGS. 5A and 5B, the impeller 1 is disposed in the accommodation space 8 of the frame 7. The dotted line of FIG. 5B represents the outer periphery 11 of the impeller 1. In this embodiment, preferably but not exclusively, the shape of the first inlet 711 is circular. The first inlet 711 forms an axial projection surface as shown in FIG. 5B. The hub 2, portion of each of the plurality of first blades 3 and portion of each of the plurality of second blades 4 are exposed to the axial projection surface of the first inlet 711 axially. Furthermore, the inner end 43 of each of the plurality of second blades 4 is exposed to the axial projection surface of the first inlet 711. Preferably but not exclusively, the shape of the connecting member 5 of the impeller 1 is circular. The connecting member 5 of the impeller 1 is shielded by the frame 7, and the connecting member 5 of the impeller 1 is not exposed to the axial projection surface of the first inlet 711.

Please refer to FIGS. 5A and 5C again. The frame 7 further includes a plurality of second inlets 721. The plurality of second inlets 721 are disposed in the second surface 72. The plurality of second inlets 721 are in fluid communication with the first inlet 711, the outlet 81 and the accommodation space 8. The plurality of second inlets 721 are served as the other airflow entrances for dissipating the heat. The inlet direction of each of the plurality of second inlets 721 is perpendicular to the outlet direction of the outlet 81. The rib of the frame 7 is formed between each of the plurality of second inlets 721 and the other adjacent second inlet 721 of the plurality of second inlets 721. In this embodiment, the plurality of second inlets 721 form a plurality of axial projection surfaces as shown in FIG. 5C. Portion of each of the plurality of first blades 3 and portion of each of the plurality of second blades 4 are exposed to the plurality of axial projection surfaces of the plurality of second inlets 721. Furthermore, the inner end 43 of each of the plurality of second blades 4 is exposed to the plurality of axial projection surfaces of the plurality of second inlets 721. The connecting member 5 of the impeller 1 is shielded by the frame 7 and the connecting member 5 of the impeller 1 is not exposed to the plurality of axial projection surfaces of the plurality of second inlets 721. According to the concept of the present disclosure, the fan 6 includes dual inlets and single outlet. The fan 6 inhales the airflow axially and exhausts the airflow radially. Consequently, the air volume and the air pressure of the fan 6 are enhanced.

From the above descriptions, the present disclosure provides an impeller and a fan. With a specific arrangement between the plurality of main blades and the plurality of auxiliary blades, for example the plurality of main blades and plurality of auxiliary blades are arranged alternately, the fan can achieve target air pressure and target air volume at low rotation speed. Moreover, the noise generated by the fan is reduced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An impeller, comprising:

a hub;

a plurality of first blades disposed around the hub separately, wherein each of the plurality of first blades is connected with a periphery of the hub;

a plurality of second blades disposed around the hub separately, wherein each of the plurality of second blades is disposed away from the periphery of the hub and located between two adjacent first blades of the plurality of first blades; and a connecting member disposed around the hub and penetrated through the plurality of first blades and the plurality of second blades, wherein the connecting member is not in contact with a first edge of any side of each of the plurality of first blades, and the connecting member is not in contact with a second edge of any side of each of the plurality of second blades;

wherein the hub comprises an axis center, a first line is formed between a first leading edge of the Nth first blade of the plurality of first blades and the axis center, a second line is formed between the first leading edge of the (N+1)th first blade of the plurality of first blades and the axis center, a third line is formed between a second leading edge of the Mth second blade and the axis center, wherein the second leading edge of the second blade is located between the Nth first blade and the (N+1)th first blade, wherein a first angle is formed between the first line and the third line, a second angle is formed between the second line and the third line, and the magnitude of the first angle is not equal to that of the second angle, wherein a fourth line is formed between the first leading edge of the (N+2)th first blade of the plurality of first blades and the axis center, wherein a first combination angle is formed between the first line and the second line, a second combination angle is formed between the second line and the fourth line, and the magnitude of the first combination angle is equal to that of the second combination angle;

wherein the first line of the first blade only includes the first blade itself but no other first blades.

2. The impeller according to claim 1, wherein each of the plurality of first blades comprises a first blade surface, a second blade surface and a connecting end, the first blade surface and the second blade surface are opposite to each other, the connecting member is penetrated through a first center of the first blade surface and a second center of the second blade surface of each of the plurality of first blades, the connecting end is connected with the periphery of the hub, the first leading edge is located in an interconnection between the first blade surface and the second blade surface, and the first leading edge is located away from the hub than the connecting end.

3. The impeller according to claim 2, wherein each of the plurality of second blades comprises a third blade surface, a fourth blade surface and an inner end, the third blade surface and the fourth blade surface are opposite to each other, the connecting member is penetrated through a third center of the third blade surface and a fourth center of the fourth blade surface of each of the plurality of second blades, the inner end is adjacent to the hub, the inner end is not connected with the periphery of the hub, the second leading edge is located in an interconnection between the third blade surface and the fourth blade surface, and the second leading edge is located away from the hub than the inner end.

4. The impeller according to claim 3, wherein the distance between the inner end of each of the plurality of second blades and the periphery of the hub is identical.

5. The impeller according to claim 3, wherein a third angle is formed between the first line and the second line, a fourth angle is formed between the second line and the fourth line, and the magnitude of the third angle is not equal to that of the fourth angle.

6. A fan, comprising:

a frame comprising a first surface, a second surface, a side wall, a first inlet, an outlet and an accommodation space, wherein the first inlet is disposed in the first surface, the first surface and the second surface are opposite to each other, the outlet is disposed between the first surface and the second surface, wherein the first surface, the second surface and the side wall are defined as the accommodation space collaboratively, wherein the first inlet, the outlet and the accommodation space are in fluid communication with each other; and an impeller disposed in the accommodation space and comprising:

a hub;

a plurality of first blades disposed around the hub separately, wherein each of the plurality of first blades is connected with a periphery of the hub;

a plurality of second blades disposed around the hub separately, wherein each of the plurality of second blades is located away from the periphery of the hub and located between the two adjacent first blades of the plurality of first blades, wherein portion of each of the plurality of first blades is exposed to an axial projection surface of the first inlet axially, and portion of each of the plurality of second blades is exposed to the axial projection surface of the first inlet axially; and a connecting member disposed around the hub and penetrated through the plurality of first blades and the plurality of second blades;

wherein the hub comprises an axis center, a first line is formed between a first leading edge of the Nth first blade of the plurality of first blades and the axis center, a second line is formed between the first leading edge of the (N+1)th first blade of the plurality of first blades and the axis center, a third line is formed between a second leading edge of the Mth second blade and the axis center, wherein the second leading edge of the second blade is located between the Nth first blade and the (N+1)th first blade, wherein a first angle is formed between the first line and the third line, a second angle is formed between the second line and the third line, and the magnitude of the first angle is not equal to that of the second angle, wherein a fourth line is formed between the first leading edge of the (N+2)th first blade of the plurality of first blades and the axis center, wherein a first combination angle is formed between the first line and the second line, a second combination angle is formed between the second line and the fourth line, and the magnitude of the first combination angle is equal to that of the second combination angle;

wherein the first line of the first blade only includes the first blade itself but no other first blades.

7. The fan according to claim 6, wherein the connecting member is not in contact with a first edge of any side of each of the plurality of first blades, and the connecting member is not in contact with a second edge of any side of each of the plurality of second blades.

8. The fan according to claim 6, wherein the connecting member is not exposed to the axial projection surface of the first inlet axially.

9. The fan according to claim 6, wherein the fan further comprises at least one second inlet, the least one second inlet is disposed in the second surface, and the connecting member is not exposed to an axial projection surface of the least one second inlet.

10. The fan according to claim 6, wherein each of the plurality of first blades comprises a first blade surface, a second blade surface and a connecting end, the first blade surface and the second blade surface are opposite to each other, the connecting member is penetrated through a first center of the first blade surface and a second center of the second blade surface of each of the plurality of first blades, the connecting end is connected with the periphery of the hub, the first leading edge is located in an interconnection between the first blade surface and the second blade surface, and the first leading edge is located away from the hub than the connecting end.

11. The fan according to claim 10, wherein each of the plurality of second blades comprises a third blade surface, a fourth blade surface and an inner end, the third blade surface and the fourth blade surface are opposite to each other, the connecting member is penetrated through a third center of the third blade surface and a fourth center of the fourth blade surface of each of the plurality of second blades, the inner end is adjacent to the hub, the inner end is not connected with the periphery of the hub, the inner end of the second blade is exposed to the axial projection surface of the first inlet, the second leading edge is located in an interconnection between the third blade surface and the fourth blade surface, and the second leading edge is located away from the hub than the inner end.

12. The fan according to claim 11, wherein a third angle is formed between the first line and the second line, a fourth angle is formed between the second line and the fourth line, and the magnitude of the third angle is not equal to that of the fourth angle.

* * * * *